US006110000A

United States Patent [19]

Ting

[11] Patent Number: 6,110,000

[45] Date of Patent: Aug. 29, 2000

[54] DOLL SET WITH UNIDIRECTIONAL INFRARED COMMUNICATION FOR SIMULATING CONVERSATION

[75] Inventor: Charles Ting, Taipei, Taiwan

[73] Assignee: T.L. Products Promoting Co., Taipai, Taiwan

[21] Appl. No.: 09/021,238

[22] Filed: Feb. 10, 1998

[51] Int. Cl.[7] ..... A63H 3/28; A63H 30/00

[52] U.S. Cl. ..... 446/302; 446/297; 446/175

[58] Field of Search ..... 446/175, 297, 446/298, 299, 302, 303, 485

[56] References Cited

U.S. PATENT DOCUMENTS

| | | | |
|---|---|---|---|
| 4,696,653 | 9/1987 | McKeefery | 446/175 |
| 4,737,131 | 4/1988 | Sirota | 446/303 X |
| 4,773,888 | 9/1988 | Worsham et al. | 446/303 |
| 4,857,030 | 8/1989 | Rose | 446/303 |
| 5,013,276 | 5/1991 | Garfinkel | 446/175 X |
| 5,375,847 | 12/1994 | Fromm et al. | 446/175 X |
| 5,452,901 | 9/1995 | Nakada et al. | 446/175 X |
| 5,655,945 | 8/1997 | Jani | 446/299 X |
| 5,864,626 | 1/1999 | Braun et al. | 381/81 |

*Primary Examiner*—D. Neal Muir

*Attorney, Agent, or Firm*—Cohen, Pontani, Lieberman & Pavane

[57] ABSTRACT

A child's toy having a wireless transmission unit mounted in a first object, such as a doll, and a receiver unit mounted in a second object, such as another doll. The transmission unit includes a first integrated circuit (IC) for producing at least one of an audible sound and movement of a portion of the first object and an infrared transmission circuit for transmitting an infrared signal at the completion of the action. A receiving unit mounted in the second object includes a receiving circuit for receiving the infrared signal. The receiving unit also includes a second IC for producing at least one of an audible sound and movement of a portion of the second object in response to the infrared signal, thus simulating an interaction, such as a conversation, between the first object and the second object.

24 Claims, 8 Drawing Sheets

Q1, Q2...Qn
QUESTION SPEECH GROUP 1, 2, 3....n

A1, A2...An
ANSWERING SPEECH GROUP 1,2,3...n

DOLL SET WITH UNIDIRECTIONAL INFRARED COMMUNICATION FOR SIMULATING CONVERSATION

BACKGROUND OF THE INVENTION

1. Field of the Invention

The present invention relates to a child's toy including two separate characters having a unidirectional infrared transceiver. More specifically, the present invention relates to a child's toy including at least two characters, such as dolls, and which includes a transmitter mounted in one of the characters and a receiver mounted in the other of the characters such that the receiver responds to the transmitter to simulate interaction, such as conversation, between the two characters.

2. Description of the Related Art

There are many types of children's toys which exhibit some type of interaction to external parameters such as touch or spoken words or sounds from a child user. Such toys appear to interact in some way with the user of the toy, i.e., the child playing with the toy. More sophisticated toys include those which respond to signals transmitted through a television program or a computer terminal so that the toy appears to react to the television program or computer.

SUMMARY OF THE INVENTION

The object of the present invention is to provide a child's toy that includes two separate characters which appear to interact, as by having a conversation.

It is another object of the present invention to provide a child's toy which includes two separate characters and which employs a unidirectional infrared transceiver to simulate interaction, such as a conversation.

The present invention includes two separate pieces, such as dolls. Each doll includes an electronic circuit for simulating at least one of sound and movement. For example, in the case of sound, the electronic circuit in each doll preferably comprises an audio circuit having an audio memory device for storing audio data representing sounds, such as speech, and a speaker for converting the audio data to sound. In the case of movement each doll includes a movable member, such as a moveable mouth or limb, and the electronic circuit preferably comprises a movement memory device for storing data representative of movement of said moveable member and a driving mechanism responsive to said stored data for moving said movable member.

In either event, a first of the dolls includes a transmitter and a second of the dolls includes a receiver. In response to activation of a switch mounted on the first doll, the electronic circuit in the first doll generates movement and/or sound, such as speech, preferably in the form of a question. At the same time or thereafter, the transmitter transmits a signal, preferably an infrared signal comprising a series of data pulses, which contains information identifying an address in the memory of the second doll where data is stored representing an appropriate response to the movement and/or sound generated by the first doll. The receiver receives the signal transmitted by the transmitter and transmits it to the electronic circuit in the second doll whereupon the memory address identified in the transmitted signal is accessed and the second doll generates a movement and/or sound seemingly responsive to the movement and/or sound previously generated by the first doll. For example, if the first doll generates sound simulating a spoken question, the data pulses would identify a memory address in the second doll containing data representative of an appropriate answer to the question whereupon that memory address would be accessed and the second doll would generate a sound simulating a spoken response to the question. By using a unidirectional transceiver in this way, the first doll controls the response of the second doll such that the two dolls appear to interact.

In an alternative embodiment, only the electronic circuit in the first doll includes a memory device, and the memory device stores data representative of the movements and/or sounds generated by both dolls. In this embodiment, the signal transmitted by the transmitter in the first doll would include data for activating the electronic circuit in the second doll to generate an appropriate response to the movement and/or sound previously generated by the first doll.

In either embodiment, after the second doll responds to the movement and/or sound generated by the first doll, the electronic circuit in the first doll may be programmed to generate a second, different movement and/or sound whereupon the transmitter transmits to the receiver in the second doll data pulses identifying the address of an appropriate response whereupon the second doll appropriately responds to this second movement and/or sound as explained above. It will be apparent that this process may be repeated indefinitely with the first doll cycling through the data stored in its memory to successively or randomly generate various movements and/or sounds. If the first doll is programmed to generate successive movements and/or sounds, then the first doll may include data in its memory indicative of the duration of the second doll's response to the movement and/or sound generated by the first doll and the electronic circuit in the first doll may be programmed to not generate a new movement and/or sound until the duration of the response has lapsed. Alternatively, and especially if all of the responses are of approximately the same duration, the electronic circuit in the first doll may be programmed to not generate a new movement and/or sound for a predetermined duration equal to or greater than the duration of the longest response. As a further alternative, after the second doll completes its response, the first doll will not generate a second movement and/or sound until the user again activates the first doll, as by activating a switch, such for example as a manual switch or a sound and/or motion activated switch.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
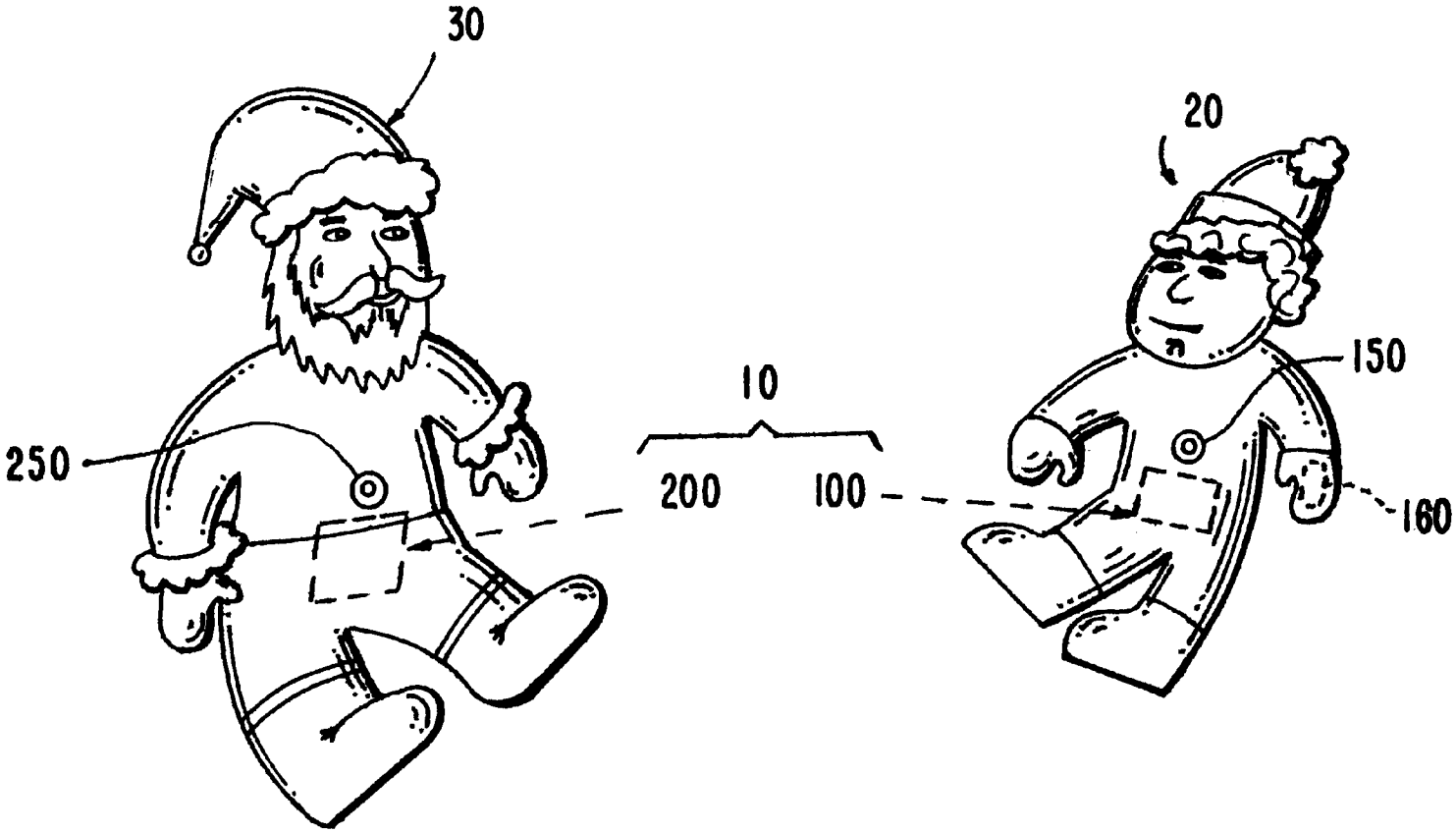
FIG. 1 is a diagrammatic view of an embodiment of the invention incorporated in a pair of dolls.

With reference to FIG. 1, a preferred embodiment of a device for simulating an interaction between two toys includes a transceiver 10 having a transmission unit 100 mounted in a first toy 20 and a receiver unit 200 mounted in a second toy 30. Each toy 20, 30 in this embodiment includes a speaker (see FIGS. 2 and 4), and both the transmission unit 100 and receiver unit 200 play back audio signals stored therein to simulate speech by the toys. The first toy 20 also includes an emitting diode 150 which is connected to the transmission unit 100 for transmitting infrared signals and a switch 160 for activating the transmission unit 100. The second toy 30 includes a photodetector, such as a photodiode 250, connected to the receiver unit 200 for receiving the infrared signals transmitted by the emitting diode 150. The transmission unit 100 generates an audio question in response to the operation of switch 160. When playback of the question has been completed, the emitting diode 150 transmits an infrared signal. The photo diode 250 receives the infrared signal and transmits a play signal to the receiver unit 200. Depending upon the particular play signal generated by the transmission unit 100, the receiver unit 200 selects and plays back an appropriate answer to the question posed by the first doll 20. Using the emitting diode 150 and the photo diode 250 in this way, the first toy 20 and the second toy 30 interact to simulate a conversation. In the specific embodiment, the first toy 20 is a doll formed to resemble a child and the second toy 30 is a doll formed to look like Santa Claus. The child asks Santa questions and Santa replies. Nevertheless, the first toy 20 and second toy 30 may alternately be any characters or inanimate objects which are made to appear to converse with each other.

Although the terms "question" and "answer" are used herein to describe the audio signals generated by the first and second toys 20, 30, the audio signals that are generated do not necessarily have to be in the form of questions and answers and may instead be any type of audio communication, such as a sentence, portions of a sentence, words, song portions, or any other voiced sound or expression.

Figure 2:
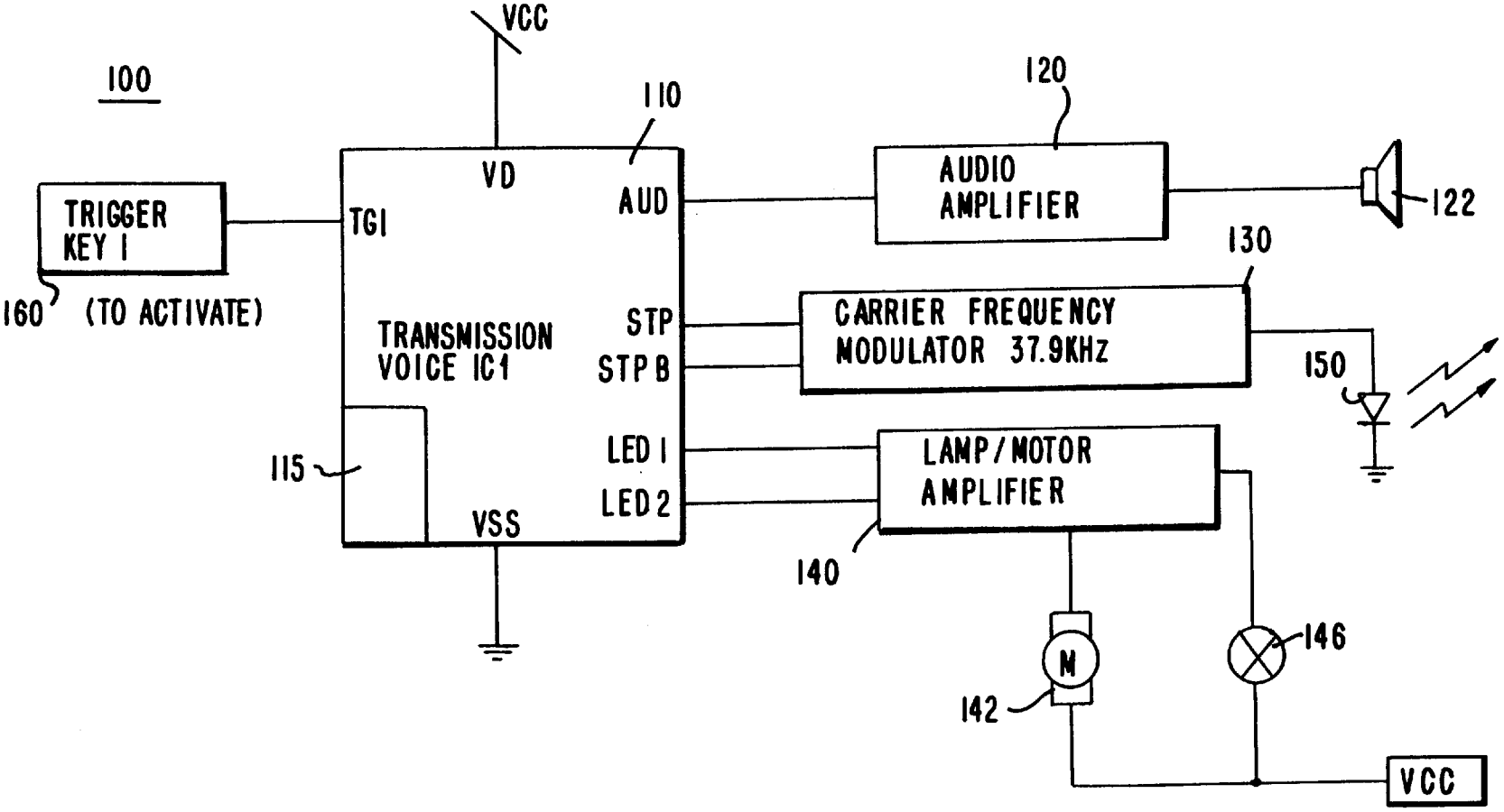
FIG. 2 is a block diagram of a transmitter suitable for use in the present invention.
Figure 4:
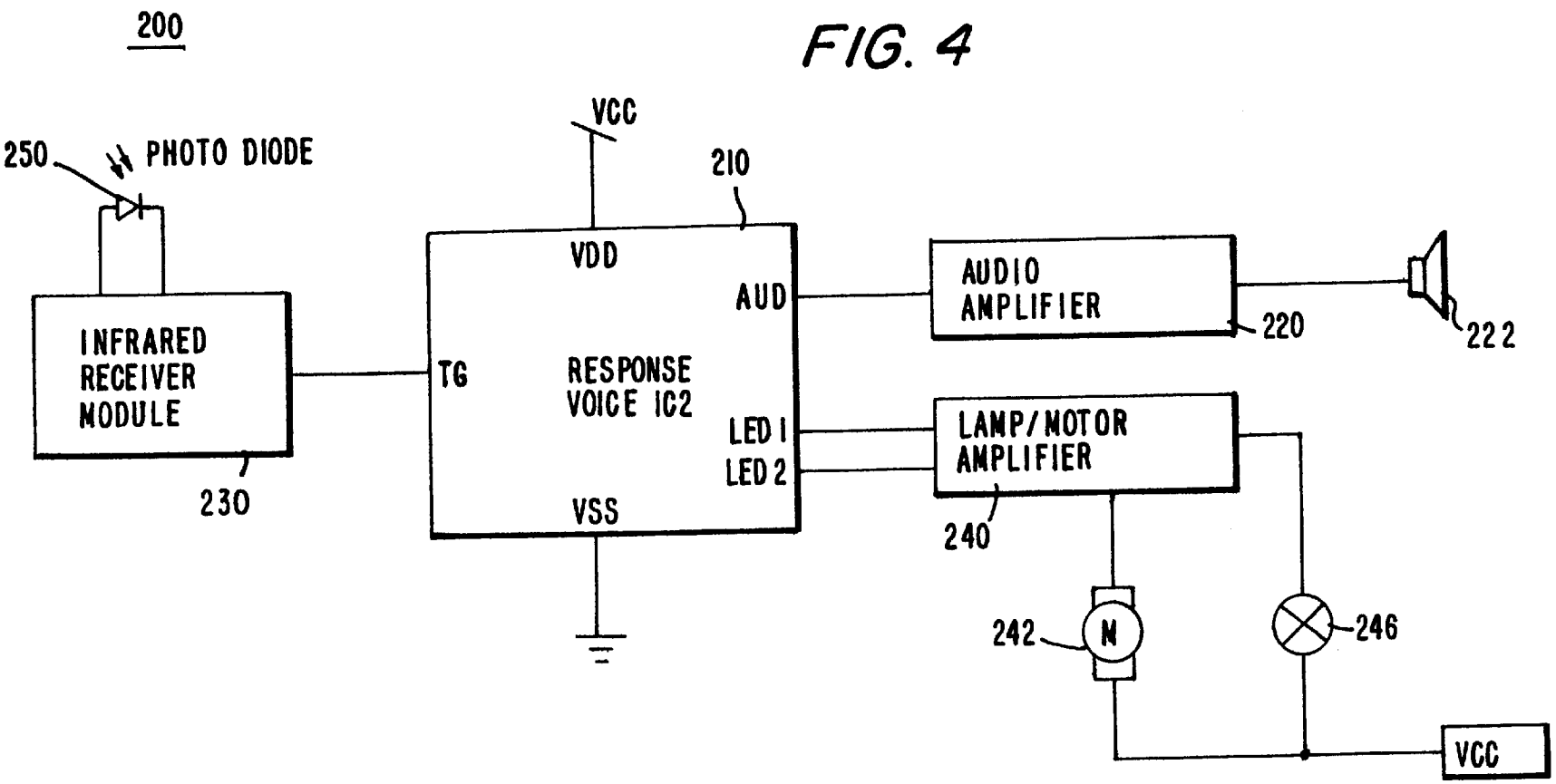
FIG. 4 is a block diagram of a receiver suitable for use in the present invention.

The first and second toys 20, 30 also optionally include motors and/or lights for animating the dolls (see FIGS. 2 and 4). In that event, the interaction of the toys may additionally and/or instead take the form of physical actions such as movement of the first and second toys 20 and 30 generated by the motors, illumination of a portion of the doll generated by the lights, or some combination thereof. Examples of such movement-type responses include the raising of one or both arms, waving of a hand, opening of the mouth (e.g., dropping the jaw), nodding the head, and pivoting of the head back and forth. Such movement and lights may be used in combination with the audio output to more realistically animate the toys during playback of an audible question or answer.

Figure 3:
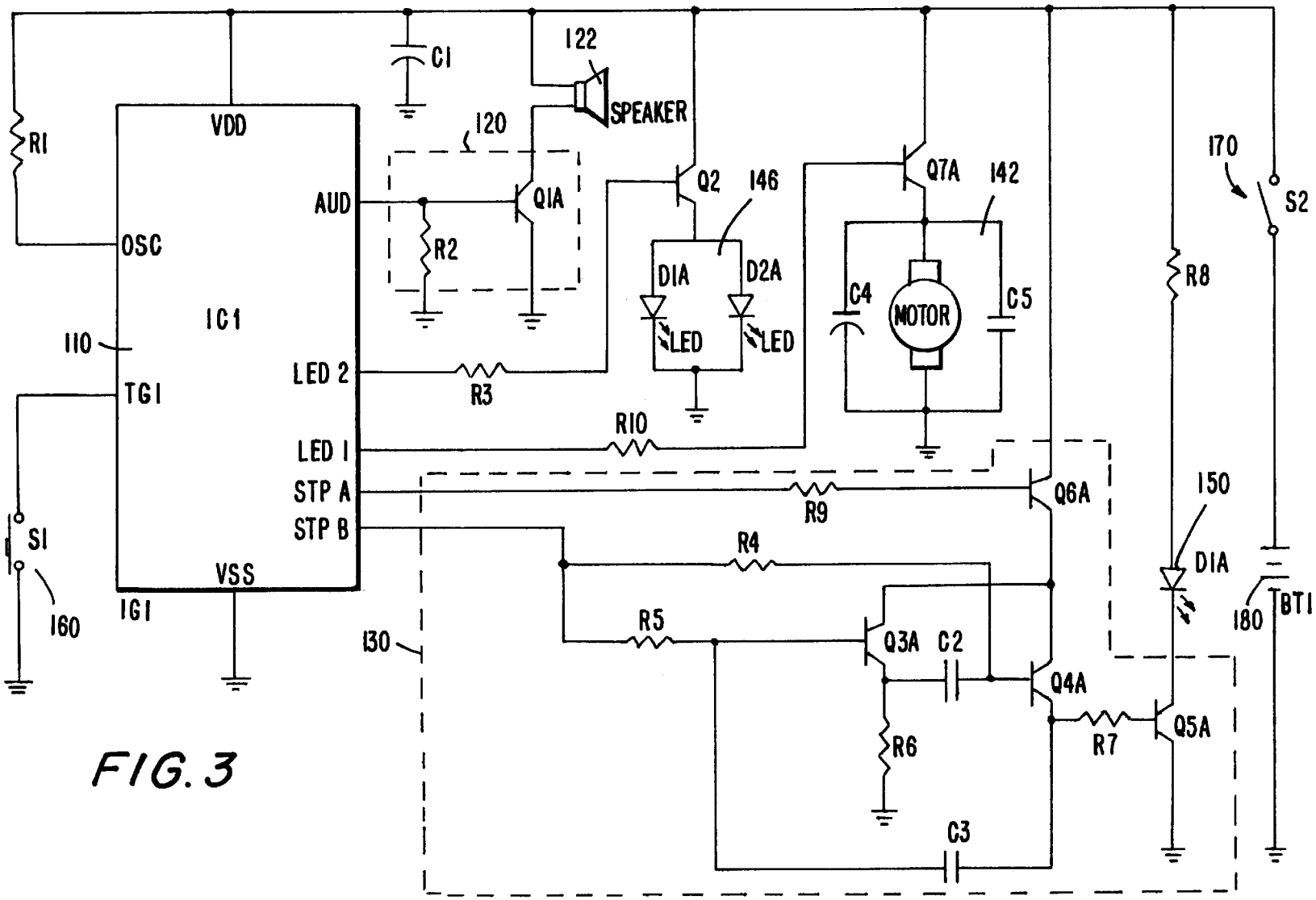
FIG. 3 is a schematic diagram of the transmitter of FIG. 2.

With reference now to FIGS. 2 and 3, the transmission unit 100 includes a transmission voice integrated circuit (IC) 110. In the preferred embodiment, the transmission voice IC comprises a Winbond W58105 integrated circuit. Transmission voice IC 110 includes a first memory device 115 in which a transmission program is encoded. The transmission voice IC 110 comprises an audio output AUD, carrier frequency outputs STPA and STPB, and auxiliary outputs LED1 and LED2. An audio amplifier 120 that is connected to a speaker 122 is electrically connected to the audio output AUD of the transmission voice IC 110. The transmission unit 100 also includes a carrier frequency modulator 130 having an emitting diode 150 connected to the carrier frequency outputs STPA and STPB. The transmission unit 100 may optionally comprise a lamp/motor amplifier 140 with a motor 142 and a lamp 146 connected to the auxiliary outputs LED1 and LED2. The transmission unit 100 also includes a power supply 180, an ON/OFF switch 170, and the switch 160 which is preferably a momentary switch.

When ON/OFF switch 170 is closed and switch 160 is operated, transmission voice IC 110 begins to execute the transmission program encoded in memory 115. The transmission program typically includes an audio signal that is transmitted to the audio amplifier 120 and/or an action signal which is transmitted to the motor 142 and/or lights 146. The audio amplifier 120 amplifies the audio signal to an amplitude sufficient to drive the speaker 122 which audibly reproduces the audio signal so that the first toy 20 appears to ask a question. If the signal is or includes an action signal, then the motor 142 and/or lights 146 are activated by the signal to animate the first doll 20. After the question or action is completed, the transmission program transmits signals through carrier frequency outputs STPA and STPB to the carrier frequency modulator 130 (STPA and STPB signals are hereinafter discussed in further detail). The output of carrier frequency modulator 130 is transmitted to the emitting diode 150 which emits an infrared signal in response to the STPB signal. In embodiments in which the transmission program includes an audio signal and an action signal for concurrent or combined transmission, the lamp/motor amplifier 140 may be used to drive the motor 142 and/or the lamp 146 to provide movement and/or light of the first toy 20 for animating the first toy while it is asking a question.

If the transmission program contains another question to be asked or action to be performed, then the program executes a silence interval or period after transmitting the STPA and STPB signals, during which the first toy 20 remains silent and thereby allows the second toy 30 to respond to the question. After the silence interval, which is of sufficient duration to allow the question to be audibly answered, a subsequent question may be output from the first toy and the process repeated until all questions in the program have been asked or until the switch 160 is pressed again to deactivate the unit.

Figure 5:
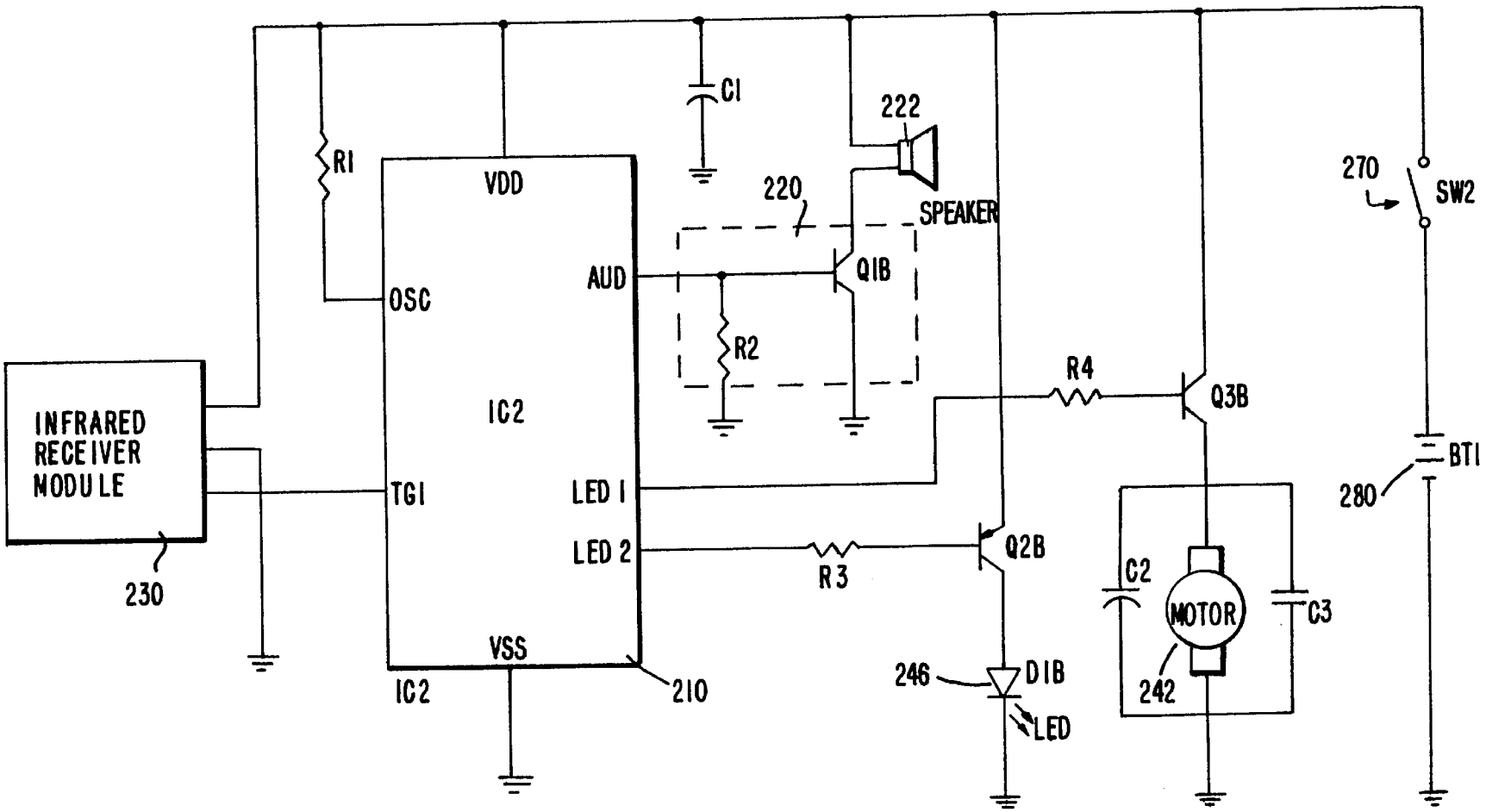
FIG. 5 is a schematic diagram of the receiver of FIG. 4.

With reference now to FIGS. 4 and 5, the receiver unit 200 comprises a response voice IC 210. In the preferred embodiment, the response voice IC 210 comprises a Winbond W58105 integrated circuit, which includes a memory 215 in which a response program is encoded. Response voice IC 210 also includes an audio output AUD and auxiliary outputs LED1 and LED2. The photodiode 250 is connected to an infrared receiver module 230 which provides an input to the response voice IC 210. For the infrared receiver module 230, any suitable infrared module operable for receiving the output of the photodiode and transmitting a play signal to the response voice IC 210 may be used. An audio amplifier 220 with a speaker 222 is connected to the audio output AUD. The receiver unit 200 may optionally comprise a lamp/motor amplifier 240 with a motor 242 and lamp 246 connected to the auxiliary outputs LED1 and LED2. The receiver unit 200 also includes a power supply 280 and an ON/OFF switch 270.

When the ON/OFF switch 270 is closed and the photodiode 250 receives an infrared signal transmitted from the emitting diode 150 of the transmission unit 100 of FIGS. 2 and 3, the infrared receiver module 230 converts the infrared signal to the play signal described above and transmits it to the response voice IC 210. In the preferred embodiment, the play signal is or includes a pointer that indicates the position within memory 215 of the audio signal to be played back or the action signal to be implemented. The play signal may also include data that itself represents or encodes the answer to be played back or action to be performed. The response voice IC 210 initiates the response program in memory 215 and transmits the answer thereby selected in accordance with the play signal to the audio amplifier 220 to audibly output the answer associated with the question posed by the first toy 20 through speaker 222. The lamp/motor amplifier 240 connected to response IC 210 is used to provide motion and/or lights to the second toy 30 if the answer is or includes an action signal. Optionally, the answer may include both an audio signal and an action signal so that the motor 242 and/or lights 246 are activated as the speaker 222 outputs sound or speech, thus providing a lively animated delivery of the answer.

In another embodiment, the receiver unit 200 of FIGS. 4 and 5 does not include a memory but instead responds directly to the signal received from the emitting diode 150 of FIGS. 2 and 3. In this embodiment, the signal transmitted by the emitting diode 150 comprises all of the information necessary for the response voice IC 110 to output or perform its intended function. That is, instead of the response voice IC 210 receiving an indicator or pointer and looking up the information or instructions needed for a response, the transmission voice IC 110 directly transmits the information or instructions in the infrared signal.

Figure 6A:
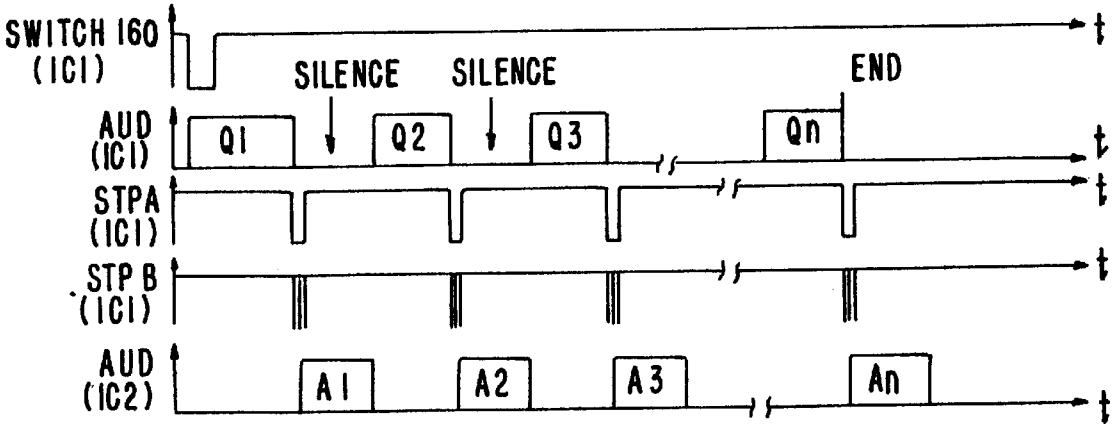
FIG. 6*a* is a timing diagram showing voltages generated during normal operation of the transceiver of the invention.

Referring now to the timing diagram of FIG. 6*a,* when switch 160 is momentarily operated the transmission program in memory 115 of transmission voice IC 110 is initiated and a first question Q1 is transmitted via an audio signal through audio output AUD to the audio amplifier and speaker. The first question Q1 may also be or include an action signal that is transmitted via the auxiliary outputs LED1 and LED2 to motor 142 and/or lights 146. Immediately following completion of the first question Q1, play signals are transmitted via STPA and STPB to the carrier frequency receiver circuit 130. As seen in FIG. 6*c,* the STPA signal is an enable signal and the STPB signal includes a head bit followed by a 4-bit data signal which is repeated. The emitting diode 150 converts the STPB signal into an infrared signal. At receiver unit 100, photodiode 250 receives the infrared signal. The head bit of the STPB signal puts the infrared receiver module 230 in a ready state to then receive the two transmissions of the 4-bit data. Infrared receiver module 230 compares the two transmissions of the 4-bit data as part of an error checking routine; if the two transmissions of the 4-bit data match, then the play signal is transmitted to the response voice IC 210. Using information in the play signal, response voice IC 210 outputs an answer A1 corresponding to the question Q1, thereby answering question Q1. In the event that the two transmissions of the 4-bit data do not match, then no play signal is transmitted to the response voice IC 210 and no answer is played back for that question.

If a subsequent signal is to be transmitted by the transmission voice IC 110 after question Q1 has been asked, then transmission voice IC 110 remains silent for a predetermined interval in a time delay or silence mode after completion of question Q1. The length of the time delay is preprogrammed to be of sufficient duration to allow the answer A1 to be completed before the next question is output. After the time delay expires, a second question Q2 is transmitted by transmission voice IC 210 through speaker 222 and the sequence is repeated until the last question has been asked and the last answer has been played.

Alternatively, if the silence period is to be approximately the same (or less than a predetermined maximum) length for each response, then the transmission voice IC 210 may utilize one time interval of a predetermined time that exceeds the longest response and which is initiated after the completion of each question.

Where an action to be performed by the first doll is a movement or an illumination, the signal Q1 is transmitted to motor 142 and/or the lights 146 via the LED1 and LED2 outputs from transmission voice IC 110. Signal Q1 may also comprise both an audio signal for transmission via the AUD output to the speakers and a signal for the motors and/or lights for transmission to the motor 142 and lights 146 via the LED1 and LED 2 outputs. Similarly, the signal A1 in response voice IC 210 may be directed to the motor 242 and lights 246 via the LED1 and LED2 outputs instead of to the speaker through the AUD output where the response is a movement rather than an audible response. Signal A1 may also comprise both an audio signal and an action signal.

In the preferred embodiment, the 4-bit data of the STPB signal is used to identify the answer to be played back in response to the most recent question that was output by transmission voice IC 110. The signal comprising 4-bit data can identify up to 16 different answers. If an 8-bit data signal is alternatively used, then the signal may be used to identify 256 different answers. Thus, the size of the STPB signal should be selected as a function of the number of different questions and answers that are to be interactively output by the toys during either a single or multiple simulated conversations or interactions.

As noted above, instead of identifying the response to be played back, the STPB signal may contain the actual response data such that the desired response is transmitted directly to the response voice IC 210 rather than being stored in the second toy and looked up in accordance with the transmitted signal pointer. In such a modified embodiment, the response voice IC would not require a memory.

The embodiment shown in FIGS. 2–5 and described above includes only a single set of questions and answers. The memory may alternately include multiple sets of questions and answers so that a different conversation can be carried out in response to, for example, subsequent operations of switch 160. Each set of questions may include one or more questions and corresponding responses.

Moreover, although the preferred embodiment described hereinabove includes only one transmission and one receiver unit, more than one receiver unit in a corresponding number of second toys 30 may be provided with each first toy 20. In such an embodiment, the single transmission unit controls all of the receiver units by transmitting infrared signals designated for the various receiving units.

Figure 6B:
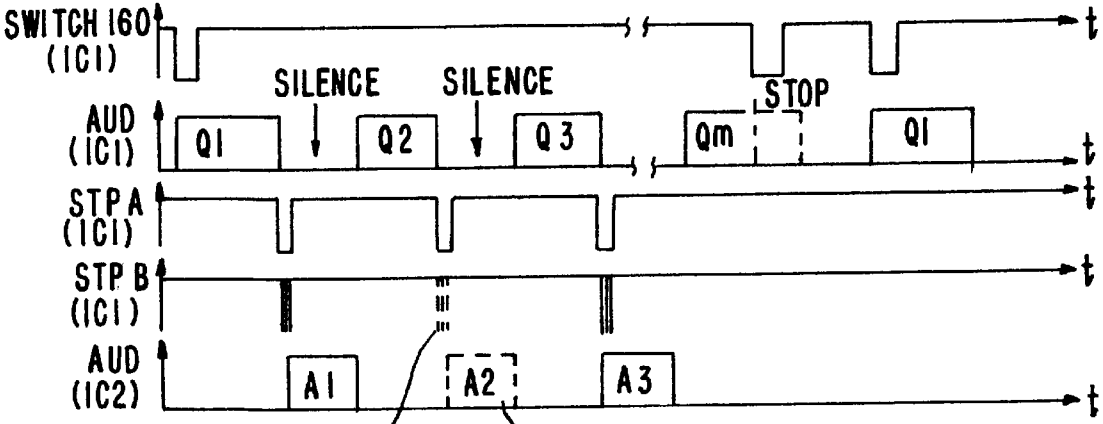
FIG. 6*b* is a timing diagram showing voltages generated during data pulse trigger failure and during a stop.
Figure 6C:
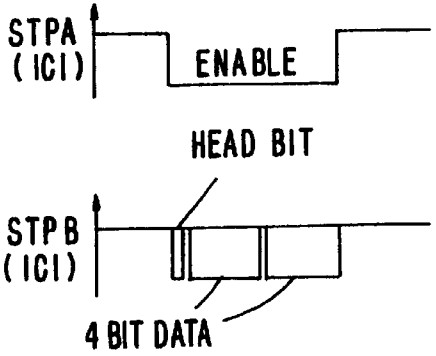
FIG. 6*c* is a timing diagram showing the enable and data pulses transmitted by the transmitter to the receiver.

Referring now to FIG. 6*b,* in the event that an error is detected by response voice IC 210 between the two transmissions of the 4-bit data groups, i.e., if the two transmissions of the 4-bit data do not match, then no playback signal is transmitted and the response voice IC 210 does not output or initiate a response. In this situation, both toys 20, 30 remain silent during the time delay interval. After the interval expires, the next question is played back by the transmission voice IC 210, and the procedure continues.

If the switch 160 is operated before the last question in a set or series is asked, the transmission program is terminated. When switch 160 is thereafter operated again, the transmission voice IC program is restarted and the first question Q1 is asked again. This termination and restarting of the program is indicated in FIG. 6*b*. Alternatively, transmission voice IC 110 can be programmed to start with a random question each time that the toy 20 is activated, or programmed to start with the question following the last question that was asked before the transmission voice IC program was terminated if the question set was not completed.

Figure 7:
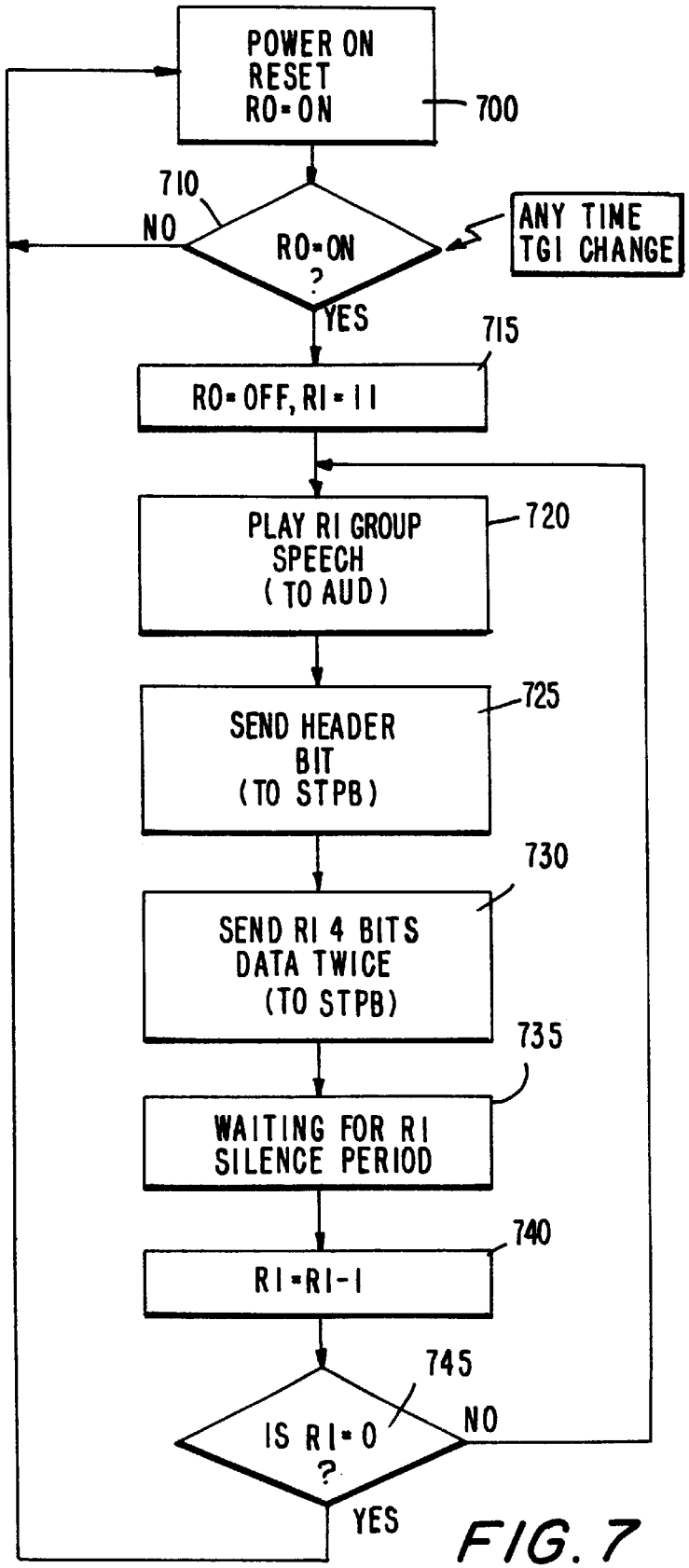
FIG. 7 is a flow diagram showing the operation of the transmitter.

With reference now to FIG. 7, the operation of transmission voice IC 110 begins at step 700. When ON/OFF switch 170 is switched from its open to its closed position, register R0 is set to ON and the transmission voice IC 110 waits for switch 160 to be operated. When switch 160 is operated, step 710 verifies that R0 is in the ON state; if not, then the program returns to step 700, i.e., back to the waiting state. If this is the first time that the program performs step 710, the answer will be YES and the program proceeds to step 715 in which the register R0 is set to OFF and another register R1 is set to the number of questions that will be asked during the set or conversation, in this illustration example 11. Of course, any number of questions can be used as a matter of design choice. In the next step 720, the question associated with the value of register R1 is transmitted to an audio amplifier and played back. In step 725, the header bit is transmitted via STPB to the emitting diode 150. In step 730, 4 bits of data associated with the value of register R1 are transmitted twice via STPB to the emitting diode 150. In step 735, transmission voice IC stays silent for a time delay interval associated with the value of register R1. In step 740, the value of register R1 is reduced by 1 and, in step 745, the value of register R1 is compared to 0. If that value equals 0, the program returns to step 700; otherwise, the program returns to step 720 to output the next question. When all questions have been played, register R1 will equal 0 and the program returns to step 700. Each time that switch 160 is operated, the program will perform step 710 and, if step 715 has already been performed, the program will return to step 700 and wait for switch 160 to be operated again. In other words, if switch 160 is operated mid-conversation, the conversation or set will be interrupted and terminate. To restart the conversation, the switch 160 must be operated again.

Figure 8:
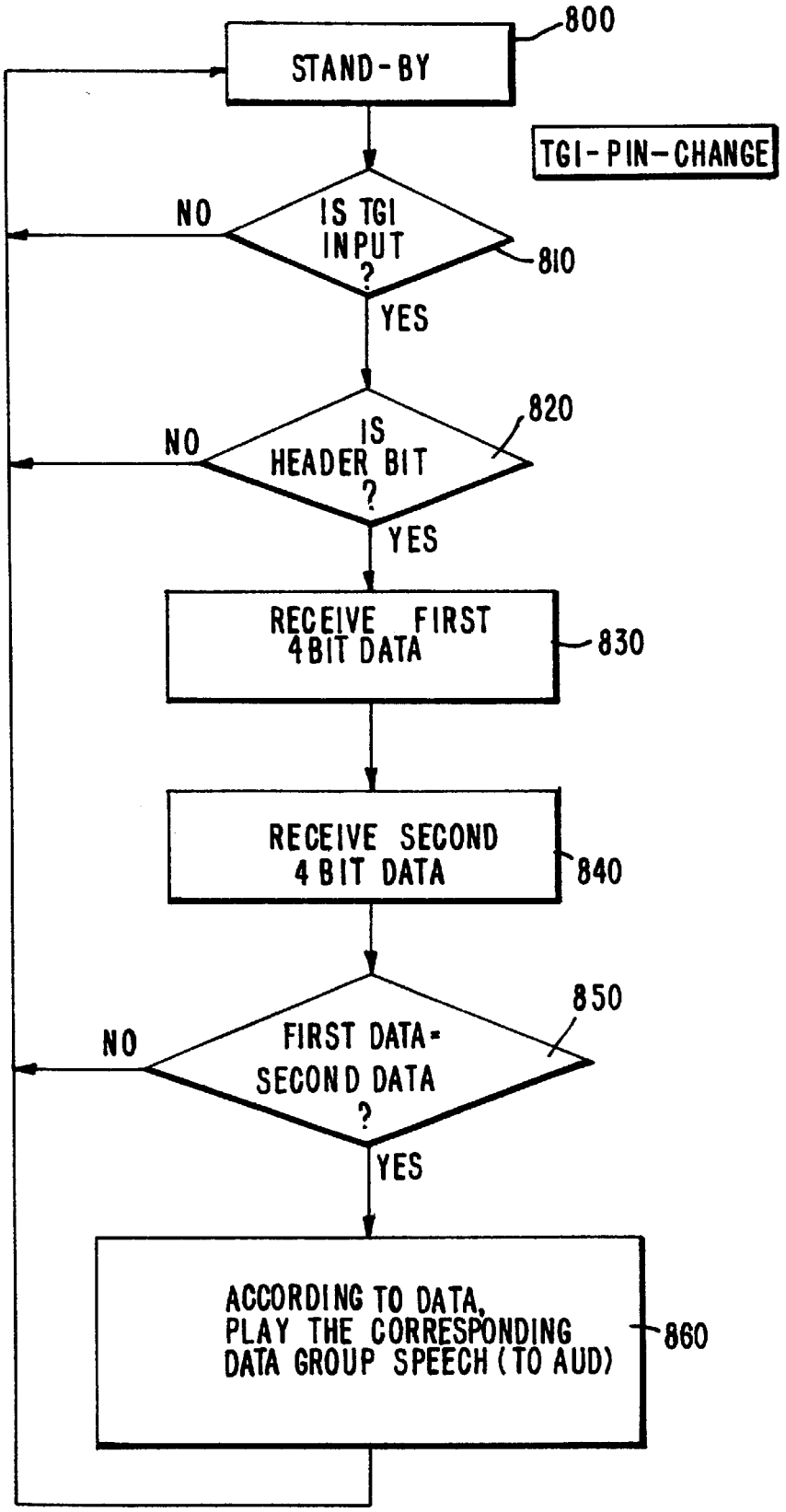
FIG. 8 is a flow diagram showing the operation of the receiver.

As seen in FIG. 8, the response voice IC program begins at step 800 in a standby state when ON/OFF switch 270 is switched from its open to its closed state. The response voice IC waits at step 810 for a TG1 input, i.e. a data pulse at infrared receiver module 230. At step 820, the program tests whether the TG1 input is the header bit; if not, then the program returns to step 800. If the TG1 input is the header bit, the program receives the first set of the 4-bit data at step 830 and the second set of the 4-bit data at step 840. At step 850, the program compares the first and second sets of the 4-bit data; if the first set of the 4-bit data equals the second set of the 4-bit data at step 850, the response voice IC plays the audio signal representing the answer associated with the 4-bit data at step 860 through speaker 222, as described above, and returns to step 800.

While there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the present invention. It is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. An apparatus for simulating a responsive interaction between first and second objects, comprising:

a first circuit mounted in the first object and operable for effecting a first action comprising one of reproducing a sound from and performing a movement by the first object;

a unidirectional wireless communication circuit comprising a transmitter circuit operatively connected to said first circuit for transmitting a signal from the first object to the second object after completion of said first action, said signal indicating a second action to be effected by the second doll in response to said first action by the first doll;

said unidirectional wireless communication circuit further comprising a receiving circuit mounted in the second object for receiving said transmitted signal; and a second circuit operatively connected to said receiving circuit for effecting said second action comprising one of reproducing a responsive sound and performing a responsive movement in response to said received signal and in simulated response to said first action by the first object, said first circuit further operable for remaining idle for a duration of time after completion of said first action and effecting a third action comprising one of reproducing a sound from and performing a movement by said first object after said duration of time has run in simulated response to said second action by said second object to thereby simulate a responsive interaction between the first object and the second object, said duration of time being based on a length of time required for said second action indicated by said signal.

2. The apparatus of claim 1, further comprising a switch mounted on the first object for external operation and operatively connected to said first circuit for initiating said one of reproducing a sound and performing an action by the first object.

3. The apparatus of claim 1, wherein said transmission circuit comprises an emitting diode and said transmitted signal comprises an infrared signal.

4. The apparatus of claim 3, wherein said receiver circuit comprises a photodetector.

5. The apparatus of claim 1, wherein said first circuit comprises an audio circuit for audibly reproducing a sound.

6. The apparatus of claim 1, wherein said second circuit comprises an audio circuit for audibly reproducing a sound.

7. The apparatus of claim 1, wherein said first circuit comprises one of a motor and a light operable for performing an action; and wherein said action comprises one of moving a portion of the first object and illuminating a portion of the first object.

8. The apparatus of claim 1, wherein said second circuit comprises one of a motor and a light operable for performing an action; and wherein said action comprises one of moving a portion of the second object and illuminating a portion of the second object.

9. An apparatus for simulating an interaction between two objects, comprising:

a first memory device in a first object of the two objects encoded with a plurality of transmission signals and a plurality of coded signals corresponding to said plurality of transmission signals;

a first circuit operatively connected to said memory device for selectively retrieving one of said plurality of transmission signals and for effecting a first action comprising one of reproducing a sound and performing a movement by the first object in response to the retrieved said one of said plurality of transmission signals;

a unidirectional wireless communication circuit comprising a transmitter circuit operatively connected to said first circuit and said first memory device for transmitting a predetermined one of said plural code signals corresponding to the retrieved one of said plurality of transmission signals after the first action by the first object is completed, said predetermined one of said plural code signals indicating a second action to be effected by the second doll in response to the first action by the first doll;

a receiving circuit mounted in said second object for receiving the transmitted predetermined one of the code signals; and a second circuit operatively connected to the receiving circuit for effecting the second action comprising one of reproducing a responsive sound and performing a responsive movement in response to said transmitted and received code signal and in simulated response to said one of reproducing a sound and performing an action by the first object, said first circuit further operable for remaining idle for a duration of time after completion of said transmitting a signal by said wireless transmission circuit and retrieving a predetermined second one of said plurality of transmission signals corresponding to said predetermined one of said plural code signals and effecting a third action comprising one of reproducing a sound from and performing a movement by said first object after said duration of time has run in simulated response to said second action by said second object to thereby simulate an interaction between the first object and the second object.

10. The apparatus of claim 9, further comprising a switch mounted on the first object for external operation and operatively connected to said first circuit for initiating the retrieval of said one of said plural transmission signals.

11. The apparatus of claim 9, wherein said transmission circuit comprises an emitting diode and said transmitted signal comprises an infrared signal.

12. The apparatus of claim 9, wherein said receiver circuit comprises a photodetector.

13. The apparatus of claim 9, wherein said transmission circuit comprises a carrier frequency modulator operable for transmitting said predetermined one of said plural code signals at a carrier frequency.

14. The apparatus of claim 13, wherein said carrier frequency is in the range of approximately 35 kHz–40 kHz.

15. The apparatus of claim 9, wherein each of said plural code signals comprises a header bit and two identical groups of data.

16. The apparatus of claim 9, wherein said second circuit comprises a second memory device encoded with plurality of response signals; and wherein each said coded signal comprises data representing a location in said second memory device of a corresponding one of said plural response signals that corresponds to one of said plural transmission signals.

17. The apparatus of claim 9, wherein said first circuit comprises an audio circuit for audibly reproducing a sound.

18. The apparatus of claim 9, wherein said second circuit comprises an audio circuit for audibly reproducing a sound.

19. The apparatus of claim 9, wherein said first circuit comprises one of a motor and a light for performing an action; and wherein said action comprises one of moving a portion of the first object and illuminating a portion of the first object.

20. The apparatus of claim 9, wherein said second circuit comprises one of a motor and a light for performing an action; and wherein said action comprises at least one of moving a portion of the second object and illuminating a portion of the second object.

21. A method of simulating an interaction between a first object, a first doll and a second object, second doll comprising the steps of:

operating a first circuit in the first object to effect a first action of the interaction in the first object, wherein said first action comprises one of audibly reproducing a sound and moving a portion of the first object;

transmitting an infrared signal from said first circuit after completion of the first action, the signal indicating a second action of the interaction to be effected by the second doll in response to the first action by the first doll;

receiving the infrared signal at a receiver circuit in the second object;

operating a second circuit in the second object in response to the received infrared signals to effect the second action by the second object of the interaction, wherein the second action comprises one of audibly reproducing a sound and moving a portion of the second object in simulated response to the first action;

initiating a silence interval in the first circuit of the first object after said step of transmitting an infrared signal, the silence interval having a duration of time based on a length of time required for completion of the second action indicated by the transmitted signal to thereby provide a sufficient time period for allowing completion of said second action by said second circuit, and wherein said first circuit is idle for the duration of time of the silence interval; and operating said first circuit in the first object to effect a third action in the first object of said simulated interaction after the silence interval has run in simulated response to said second action of said second object, wherein said third action comprises one of audibly reproducing a sound and moving a portion of the first object.

22. The method of claim 21, wherein said step of transmitting an infrared signal comprises:

transmitting a header bit;

transmitting a first data group; and transmitting a second data group identical to said first data group.

23. The method of claim 22, wherein said step of receiving said infrared signal comprises comparing said first data group to said second data group.

24. The method of claim 23, wherein said step of operating a second circuit comprises operating the second circuit in the second object in response to the received infrared signals to effect a second action by the second object when said first data group matches said second data group in said step of comparing; and not operating the second circuit in response to the received infrared signals when said first data group does not match the second data group.

* * * * *